United States Patent [19]

Kulesza et al.

[11] Patent Number: 4,466,214

[45] Date of Patent: Aug. 21, 1984

[54] IMPACT RESPONSIVE TOY VEHICLE

[75] Inventors: Ralph J. Kulesza, Chicago; Harry Disko, S. Barrington, both of Ill.

[73] Assignee: Marvin Glass & Associates, Chicago, Ill.

[21] Appl. No.: 421,372

[22] Filed: Sep. 22, 1982

[51] Int. Cl.[3] ..... A63H 17/26

[52] U.S. Cl. ..... 446/437

[58] Field of Search ..... 46/201, 202, 211, 206

[56] References Cited

U.S. PATENT DOCUMENTS

| | | | |
|---|---|---|---|
| 3,000,137 | 9/1961 | Vine | 46/211 X |
| 3,445,959 | 5/1969 | Barlow et al. | 46/202 X |
| 3,984,939 | 10/1976 | Wolgamot et al. | 46/202 |

FOREIGN PATENT DOCUMENTS

| | | | |
|---|---|---|---|
| 2033766 | 5/1980 | United Kingdom | 46/202 |

*Primary Examiner*—Mickey Yu

*Attorney, Agent, or Firm*—John S. Pacocha

[57] ABSTRACT

An impact responsive toy vehicle includes a vehicle housing mounted on a set of spaced wheels. An operator extending outwardly of the housing is actuated upon impact to release a spring biased pivotal lever arm arranged to extend downwardly of the lower surface of the vehicle. Upon actuation, the lever arm pivots downwardly against the supporting surface and pushes or pivots the vehicle, including one or more wheels, around one or more other wheels. The lever arm, which pivots generally around a horizontal axis, may be provided with a direction control member pivotally mounted on the lever arm for rotation around a generally vertical axis and arranged to initially contact the ground when the lever arm is actuated. By pivoting the member with respect to the lever arm, the direction in which the car pivots upon impact may be controlled.

7 Claims, 10 Drawing Figures

IMPACT RESPONSIVE TOY VEHICLE

BACKGROUND OF THE INVENTION

1. Field of the Invention

This invention relates generally to toy vehicles and particularly to impact responsive toy vehicles.

2. Description of the Background Art

A variety of toy vehicles which are capable of providing exciting play action are well known in the art. Among these toy vehicles are vehicles responsive to an impact. For example U.S. Pat. No. 3,959,920 to Ieda discloses a toy vehicle with a chassis and a body removably mounted thereon. The body includes a plurality of elements which are releasably connected to at least one other body element. Impact responsive means propel one of the body elements away from the vehicle chassis upon impact and the propulsion of this one body element causes sequential break away of body elements from the chassis as the first propelled body element draws with it the body element to which it is connected. An impact responsive toy is also taught by a pending U.S. patent application Ser. No. 343,879, now U.S. Pat. No. 4,413,443 issued Nov. 8, 1983. assigned to the assignee of the present invention.

While crash simulating vehicles capable of providing enjoyable play for young children are known, there is a continuing demand for new, more realistic, and more exciting devices of this type.

SUMMARY OF THE INVENTION

It is a primary object of the present invention to provide a toy vehicle which realistically and excitingly simulates a vehicle collision.

This and other objects of the present are achieved by toy vehicle with a housing supported on at least two spaced wheels for rolling movement on a supporting surface. Impact responsive means on the housing pivots the housing and at least one of the wheels with respect to the supporting surface upon impact by the housing.

DETAILED DESCRIPTION OF THE PREFERRED EMBODIMENT

Figure 1:
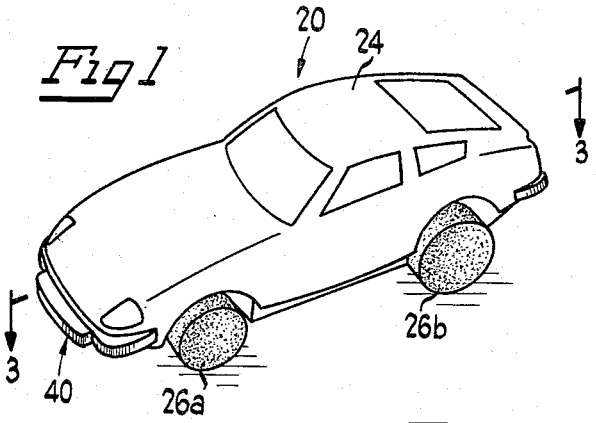
FIG. 1 is a perspective view of one embodiment of the present invention.

Referring to the drawing wherein like reference characters are used for like parts throughout the several views, there is shown in FIG. 1 an impact responsive toy vehicle 20 including a wheeled chassis 22 and a body 24. Both the body 24 and the chassis 22 are conveniently made by a conventional plastic molding techniques in the shape of a vehicle, in the illustrated embodiment, an automobile. The wheeled chassis 22 includes four wheels 26, each mounted on an axle 28 or 30.

Figure 4:
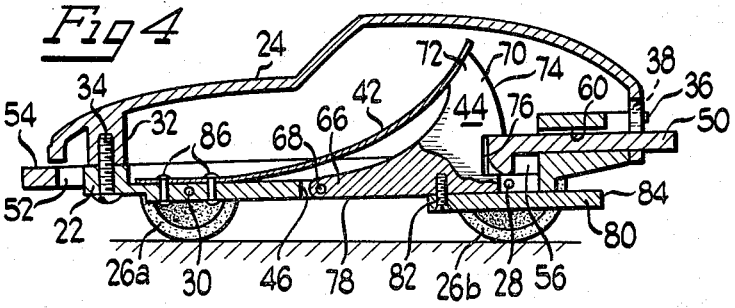
FIG. 4 is a cross-sectional view taken generally along the line 4—4 in FIG. 3.
Figure 8:
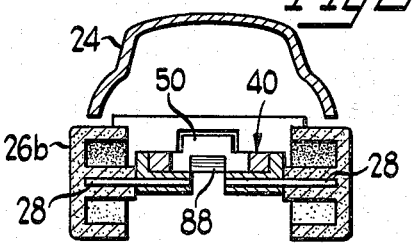
FIG. 8 is a cross-sectional view taken generally along the line 8—8 in FIG. 3.
Figure 9:
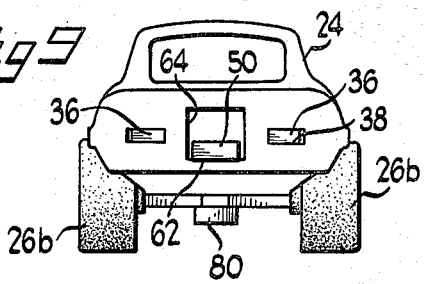
FIG. 9 is a cross-sectional view taken generally along the line 9—9 in FIG. 3.

As shown in FIG. 4, the body 24 includes an internal depending flange 32 near its forward end which receives a fastener 34 that extends through the chassis 22 in order to secure the front end of the chassis 22 to the front end of the body 24. The rear end of the chassis 22 is connected to the body 24 through the tabs 36, received within the openings 38 in the body 24.

Figure 3:
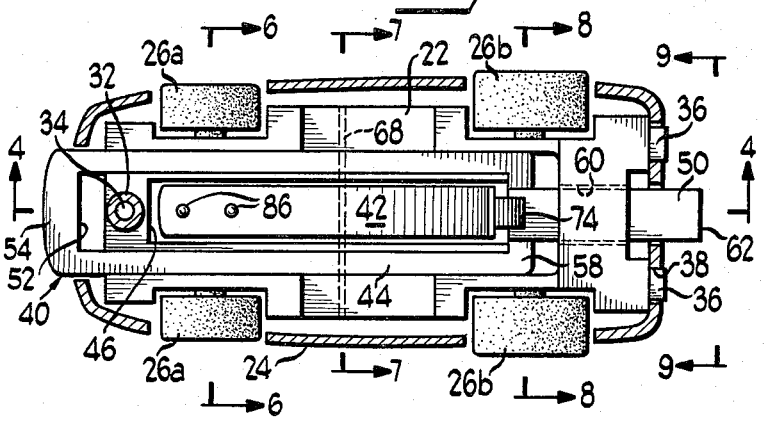
FIG. 3 is a cross-sectional view taken generally along the line 3—3 in FIG. 1.
Figure 6:
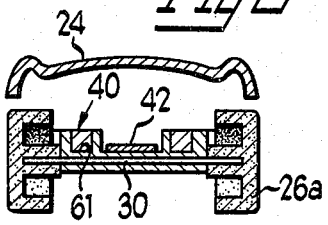
FIG. 6 is a cross-sectional view taken generally along the line 6—6 in FIG. 3.
Figure 7:
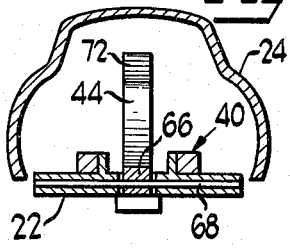
FIG. 7 is a cross-sectional view taken generally along the line 7—7 in FIG. 3.

An impact responsive actuator 40, shown in FIG. 3, is slidably mounted on the upper surface of the chassis 22. A leaf spring 42 is fixed on the upper surface of the chassis 22 and a lever arm 44 is pivotally mounted to extend through the chassis 22 by way of an opening 46.

Figure 5:
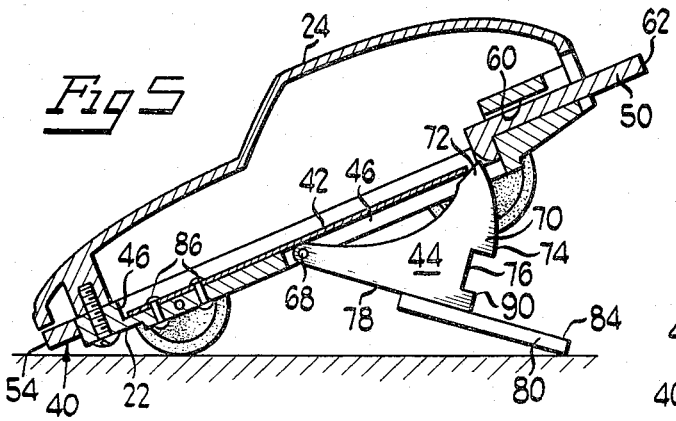
FIG. 5 is a cross-sectional view taken generally along the line 5—5 in FIG. 2.
Figure 10:
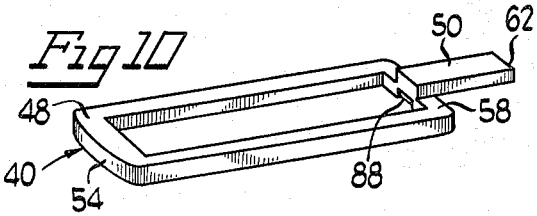
FIG. 10 is a perspective view of the impact responsive actuator shown in FIG. 3.

As shown in FIG. 10, the actuator 40 includes an open, rectangular portion 48 and a rearwardly extending tab 50. The rectangular portion 48 encircles the leaf spring 42 and lever arm 44 as well as the point of connection provided by the fastener 34 between the chassis 22 and body 24. As shown in FIG. 4, a gap 52 is provided between the leading edge portion 54 of the actuator 40 and the chassis 22 forward end. Similarly, a gap 56 is provided between the trailing edge portion 58 of the actuator 40 and the rear end of the chassis 22. Therefore, the actuator 40 is slidable between the position shown in FIG. 4 and that shown in FIG. 5. This translation is guided by the tab 50 of the actuator 40 which slides within a slot 60 in the rear portion of the chassis 22 and by the grooves 61 defined in the chassis 22 to mate with the actuator 40. The free end 62 of the tab 50 extends outwardly from the rear end of the vehicle body 24 through an opening 64.

The lever arm 44 has a broadly pie-shaped configuration. The vertex 66 of the arm 44 is pivotally mounted by a horizontally disposed pin 68 within the opening 46 in the chassis 22. From the vertex 66, the arm 44 extends rearwardly and expands to a curved, widened control portion 70. In the configuration shown in FIG. 4, the upper end 72 of the control portion 70 supports the leaf spring 42 in an upwardly deflected position. Intermediately along the peripheral edge 74 of control portion 70, a notch 76 is defined that engages and mates with the trailing edge portion 58 of the actuator 40. More particularly, the notch 76 is sufficiently wide to receive both the portion 48 and the tab 50 at their point of intersection. In this way, the lever arm 44 is arranged with its lower edge 78 generally parallel to the lower edge of the chassis 22.

Mounted on the lower edge 78, a member 80, arranged for pivotal movement around a generally vertical axis, extends beyond the peripheral edge 74 of the control portion 70, almost to the rearwardmost end of the toy vehicle 20. Conveniently, the member 80 is secured intermediately along the lower edge 78 by a fastener 82, such as a screw. The free end 84 of the member 80 is manually accessible from the rear of the vehicle 20, as indicated in FIG. 4.

The leaf spring 42 may extend along a substantial portion of the length of the vehicle 20. The leaf spring 42 is secured by the fasteners 86 to the chassis 22 near the forward end thereof and extends rearwardly over the lever arm 44. When the lever arm 44 is in its upward position, shown in FIG. 4, the leaf spring 42 is deflected upwardly. However, when the lever arm 44 is pivoted to its downward position, shown in FIG. 5, the leaf spring 42 extends parallel to the chassis 22. The leaf spring 42, near its free end, contacts and engages the angled end 72 of the control portion 70.

Figure 2:
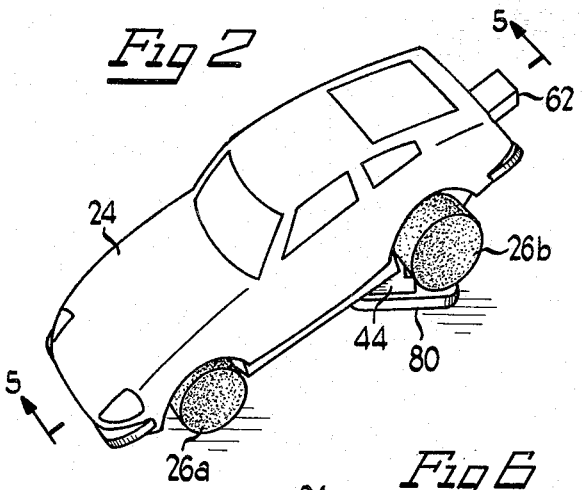
FIG. 2 is a perspective view of the embodiment of FIG. 1 in a different position.

In response to an impact between the vehicle 20 and an obstruction, the vehicle 20 pivots from the position shown in FIG. 1 generally to the position shown in FIG. 2. More specifically, the rear set of wheels 26*b* pivots generally around the front set of wheels 26*a*. As will be described in greater detail hereinafter, the exact course of pivotal movement experienced by the vehicle in response to impact is determinable to some degree by the user. However, it is preferred that the vehicle generally flip "head over heels" to enhance the excitement of the car crash simulation.

When the front end of the vehicle 20 encounters an obstruction, the leading edge portion 54 of the actuator 40 is pushed rearwardly. This is due to the arrangement of the gaps 52 and 56. After the actuator 40 moves from the position shown in FIG. 4 to the position shown in FIG. 5, the engagement of the actuator 40 with the lever arm 44 is released and the lever arm 44 is propelled downwardly, pivoting around the pivot pin 68 in response to the bias provided by the leaf spring 42 which bears against the end 72 of the control portion 70.

Eventually, the free end of the member 80 contacts the supporting surface, pivoting the vehicle 20 upwardly generally around the front set of wheels 26*a*. Generally, it is preferred that the vehicle 20 flip completely over, landing on its top, but a smaller arc of rotation may sometimes be preferred and the extent of the arc can be controlled by adjusting the bias supplied by the spring 42. The precise course which the vehicle undertakes in response to the impact is controlled by the angular setting of member 80. For example, if the member 80 is pivoted around the fastener 82 to the right, the vehicle 20 tends to roll to the left and if the member is pivoted to the left, the car tends to pivot to the right. In any case, the vehicle 20 undergoes a rear end-over-front end roll with left or right tendencies determined by the setting of the member 80. Since the member 80 extends from the rear of the vehicle 20, it may be easily manipulated and set as desired by the user.

After the impact and crash is complete, the user merely reinserts the lever arm 44 into the vehicle 20, biasing the leaf spring 42 back to its upwardly deflected position, shown in FIG. 4. Thereafter, the user must operate the tab 50 inwardly. This can be conveniently accomplished by tapping the end of the vehicle on the supporting surface. As a result, the actuator 40 engages the notch 76 in the control portion 70 of the lever arm 44. Particularly, the trailing edge portion 58 of the actuator 40 includes a curved, generally forwardly facing camming surface 88 arranged to contact the curved edge 74 and corner 90 of the arm 44 and to adjust the position of the lever arm to facilitate the engagement between the actuator 40 and the lever arm 44. At this point the vehicle 20 is again in the position shown in FIG. 4, ready for repeated actuation.

While the present invention has been described with respect to a four wheeled vehicle, those skilled in the art will appreciate that the present invention is also applicable to two-wheeled vehicles, such as motorcycles, three-wheeled vehicles, such as tricycles, and multi-wheeled vehicles, such as trucks and the like. In each of these applications, the present invention is capable of implementing a highly realistic, exciting crash sequence.

Many modifications and variations of the present invention are possible in light of the above teaching. Thus, it is the understood that, within the scope of the appended claims, the invention may be practiced otherwise than as specifically described above.

What is claimed and desired to be secured by Letters Patent of the United States is:

1. A toy vehicle comprising:

a housing supported on at least two spaced wheels for rolling movement over a supporting surface;

impact responsive means on said housing for pivoting said housing and at least one of said wheels with respect to the supporting surface, upon impact by said housing;

said impact responsive means being arranged to pivot one of said wheels over the other of said wheels;

said impact responsive means including a pivotally mounted member which extends downwardly from the interior of said vehicle in response to impact;

said pivotally mounted member contacting the supporting surface at a point beneath the rearward end of said vehicle so that said vehicle pivots in a generally rear end-over-front end manner; and manually presettable means for controlling the point at which the pivotally mounted member contacts the supporting surface.

2. The toy vehicle of claim 1, wherein said impact responsive means includes an actuator extending forwardly of said vehicle, said actuator arranged to normally engage and retain said member in its upward position and to release said member in response to the rearward translation of said actuator.

3. The toy vehicle of claim 2, wherein said member includes a curved rearwardly facing edge, said edge including a notch for engaging said actuator, said actuator including a curved edge for camming said member.

4. The toy vehicle of claim 1, wherein said manually presettable means also controls the direction of pivotal movement of said vehicle with respect to said supporting surface.

5. The toy vehicle of claim 4, wherein said manually presettable means includes a pivotal arm secured to said member and arranged to contact the supporting surface before said member.

6. The toy vehicle of claim 5, wherein said pivotal arm is arranged to rotate around a generally vertical axis to control the degree of pivotal movement of said housing around a longitudinal axis of said vehicle.

7. The toy vehicle of claim 1, wherein said vehicle includes four sets of wheels arranged in front and rear pairs, said vehicle adapted to rotate said rear pair of wheels around said front pair of wheels in response to impact.

* * * * *